US005110025A

United States Patent [19]

Unuma

[11] Patent Number: 5,110,025

[45] Date of Patent: May 5, 1992

[54] PAPER FEEDER HAVING A PAPER EXHAUSTION DETECTOR

[75] Inventor: Sadao Unuma, Aichi, Japan

[73] Assignee: Tokai Kogyo Kabushiki Kaisha, Aichi, Japan

[21] Appl. No.: 490,701

[22] Filed: Mar. 7, 1990

[30] Foreign Application Priority Data

Mar. 20, 1989 [JP] Japan ..... 1-69019
Apr. 14, 1989 [JP] Japan ..... 1-94974

[51] Int. Cl.[5] ..... B65H 20/20

[52] U.S. Cl. ..... 226/74; 400/616.1; 400/608; 226/82

[58] Field of Search ..... 226/74, 75, 82, 83, 226/84, 85; 400/616, 616.1, 616.2, 608, 608.1

[56] References Cited

U.S. PATENT DOCUMENTS

| | | | |
|---|---|---|---|
| 4,129,239 | 12/1978 | Hubbard | 226/75 |
| 4,194,660 | 3/1980 | Seitz | 226/74 |
| 4,214,691 | 7/1980 | Van Namen | 226/74 |
| 4,359,179 | 11/1982 | Waiss | 226/74 X |
| 4,643,603 | 2/1987 | Hauslaib | 226/74 X |
| 4,706,861 | 11/1987 | Kerivan | 226/74 |
| 4,735,352 | 4/1988 | Ueno et al. | 228/74 |

FOREIGN PATENT DOCUMENTS

| | | | |
|---|---|---|---|
| 0164166 | 9/1984 | Japan | 400/616.1 |
| 0138067 | 5/1990 | Japan | 226/74 |

*Primary Examiner*—Daniel P. Stodola

*Assistant Examiner*—Paul Thomas Bowen

*Attorney, Agent, or Firm*—Wenderoth, Lind & Ponack

[57] ABSTRACT

A cover is disclosed for a paper feed tractor having first and second side frames, a paper receiving plate extending perpendicularly from the second side frame and having a hole formed therein, and a paper exhaustion detector mounted to the second side frame. The paper exhaust detector of the paper feed tractor includes a microswitch with an upwardly biased plunger, and an actuator pressed upwardly by the plunger and pivotable between a first position in which it detects the presence of paper and a second position in which it detects the absence of paper. The cover of the present invention includes a plate, and elongated ribs projecting downwardly from the bottom surface of the plate on opposing sides of an elongated slot formed through the plate. The cover is characterized in that rib type elongated paper contactors project downwardly from the bottom surface of the plate at a position in which, when the plate is positioned directly above the paper receiving plate, the contactors will be adjacent the hole formed through the paper receiving plate. In this manner, when paper is fed between the paper receiving plate and the plate of the cover, the portion of the paper which is pressed upwardly by a contact portion of the actuator of the paper exhaustion detector is supported by the paper contactors so that the paper is not significantly deformed upwardly. In this manner, errors in detecting whether the paper is present or is exhausted are avoided.

5 Claims, 13 Drawing Sheets

FIG. 26 - PRIOR ART
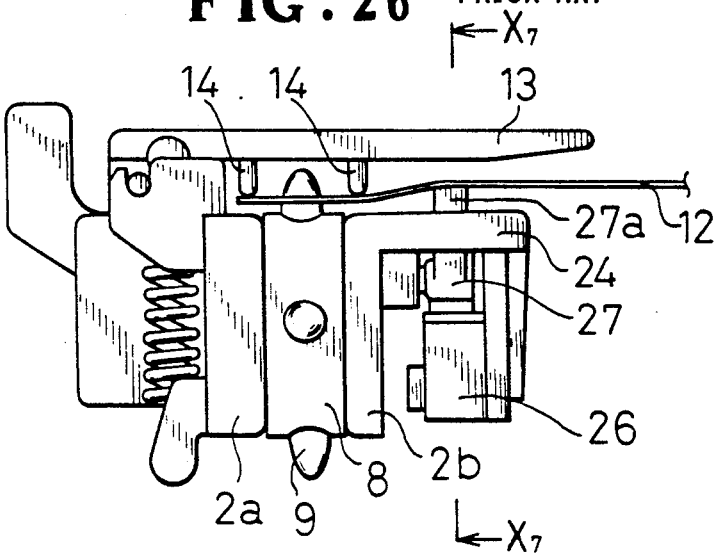
FIG. 27 - PRIOR ART
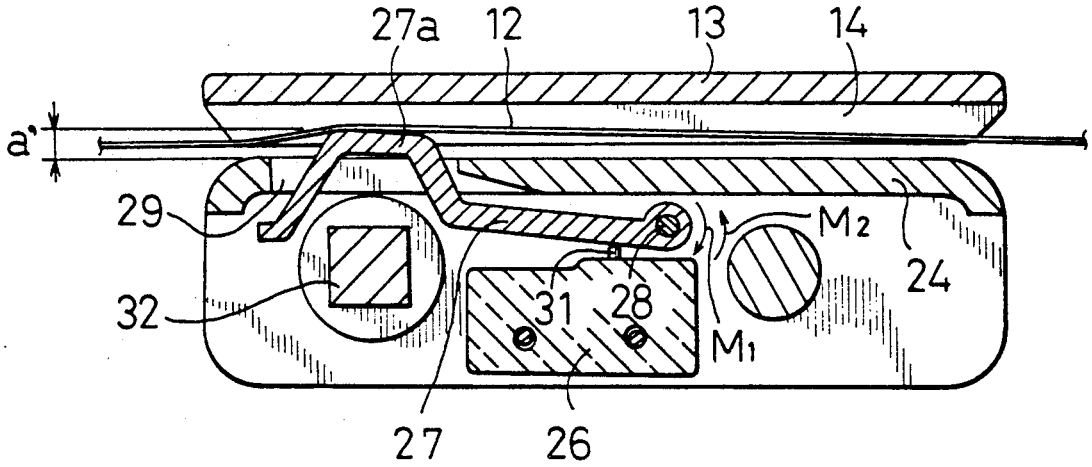

FIG. 28 - PRIOR ART
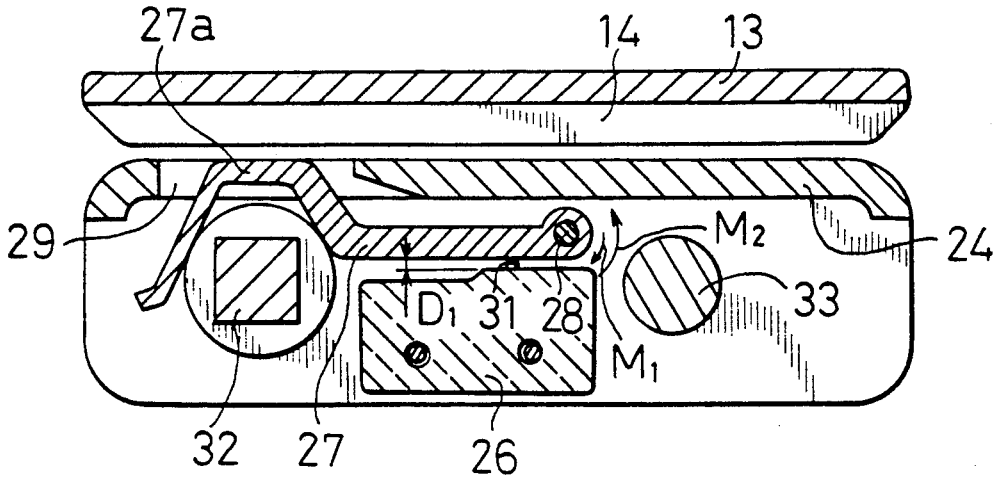
FIG. 29 - PRIOR ART
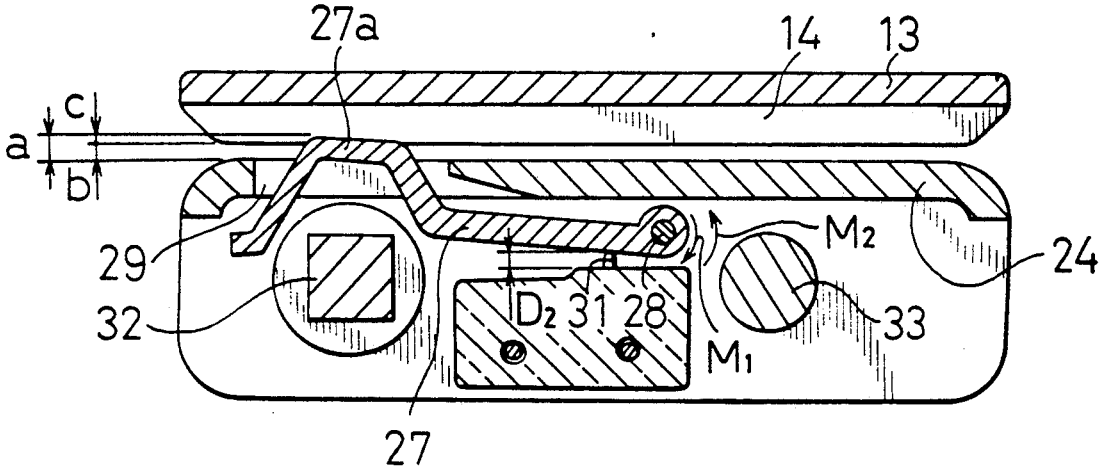
FIG. 30 - PRIOR ART
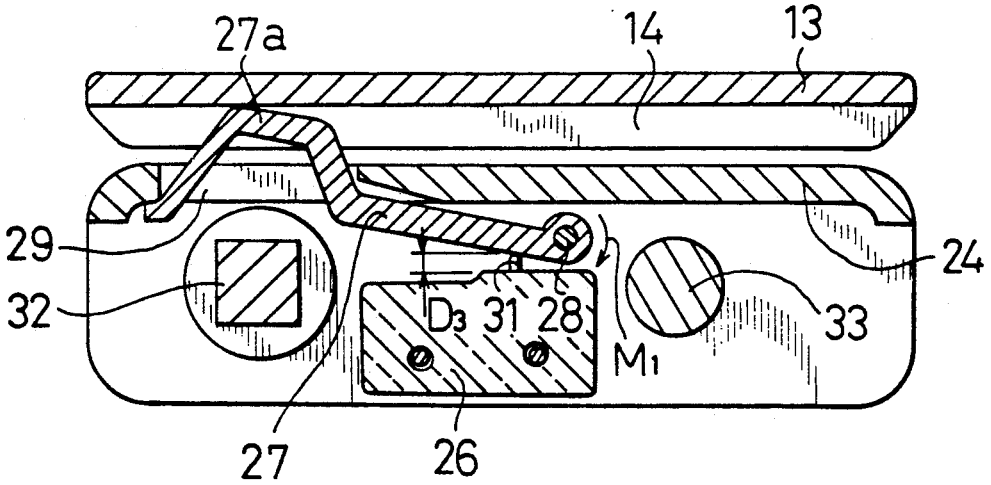

PAPER FEEDER HAVING A PAPER EXHAUSTION DETECTOR

BACKGROUND OF THE INVENTION

1. Field of the Invention

This invention relates to a paper exhaustion detector for a paper feeder adapted to feed paper with a contact portion of an actuator of the exhaustion detector contacting the lower surface of the paper, and detect the exhaustion of the paper when the contact portion of the actuator is displaced to a position higher than a set position.

2. Prior Art

A paper feeder is installed in a printer for a computer and a word processor and for used to print words on paper 12 which has perforations 12*a* in both edge portions thereof as shown in FIG. 2, and which is fed intermittently.

The paper 12 having such perforations 12*a* is also called continuous paper but even such continuous paper necessarily runs out during printing.

If a printing operation is continued with the paper exhausted, the head of a printer works idly to print letters uselessly on a platen (a member holding the paper, disposed on the opposite side of the head of a printer and receiving impact during a printing operation), so that both the head and platen are damaged.

To prevent these inconveniences, it is necessary that a paper exhaustion detector be provided at the portion of a path of paper which is immediately before the head of a printer, the paper exhaustion detector being attached unitarily to a paper feeder.

A conventional paper feeder provided with such a paper exhaustion detector is shown in FIGS. 26–30.

An endless feed belt 8 for feeding paper 12 is provided between first and second side frames 2*a*, 2*b*, and has a plurality of feed pins 9 adapted to be inserted into the perforations 12*a* in the paper 12 and extending outwardly at predetermined intervals.

A cover 13 for preventing the paper 12 being fed from floating out of engagement with the feed pine 9 is joined to the first side frame 2*a* so that the cover 13 can be opened and closed, and a microswitch 26 is attached to the second side frame 2*b*.

The second side frame 2*b* is provided with a paper receiving plate 24 extending sideways and horizontally therefrom and formed integrally therewith, and the microswitch 26 is attached to the lower side of this paper receiving plate 24.

An actuator 27 is provided between the paper receiving plate 24 and microswitch 26, which is operated by this actuator 27. The actuator 27 is formed so that it can be turned around a fulcrum pin 28, and a contact portion 27*a* of the actuator 27 projects above the upper surface of the paper receiving plate 24 through a bore 29 provided in the same plate 24.

When the cover 13 joined to the first side frame 2*a* is closed, it extends over the paper receiving plate 24. Guide ribs 14 project in parallel with the side frames 2*a*, 2*b* from the portions of the rear surface of the cover 13 which are opposed to the first and second side frames 2*a*, 2*b* when the cover 13 is in a closed position. These guide ribs 14 prevent both edge portions of the paper 12 from floating.

A pin plunger 31 of the microswitch 26 is urged in its projecting direction by a compression spring (not shown) contained in the microswitch 26, and contacts the lower surface of a base end portion of the actuator 27. Therefore, the actuator 27 receives from the pin plunger 31 first angular moment $M_1$ by which the contact portion 27*a* thereof is displaced upward, and also from the paper 12 passing between the paper receiving plate 24 and cover 13*a* second angular moment $M_2$ by which the contact portion 27*a* is displaced downward. The position of the contact portion 27*a* of the actuator 27 is fixed when the first and second angular moments $M_1$, $M_2$ act against which the actuator 27 in opposing directions, are balanced.

FIG. 28 shows a condition of the actuator 27 when the second angular moment $M_2$ largely exceeds the first angular moment $M_1$ and causes the upper surface of the contact portion 27*a* of the actuator 27 and that of the paper receiving plate 24 to become substantially flush with each other.

In this condition, the projecting length of the pin plunger 31 is $D_1$, and a signal representative of the presence of the paper 12 between the paper receiving plate 24 and cover 13 is outputted from the microswitch 26.

FIG. 29 shows a condition of the actuator 27 when the first and second angular moments $M_1$, $M_2$ are balanced, with a distance a between the upper surface of the contact portion 27*a* of the actuator 27 and that of the paper receiving plate 24 which is larger than a distance b between the upper surface of the paper receiving plate 24 and the lower surface of the opposed guide rib 14. In this condition, the projecting length of the pin plunger 31 is $D_2$, which indicates a limit level up to which a signal representative of the presence of the paper 12 is outputted from the microswitch 26. Namely, even when the contact portion 27*a* of the actuator 27 is displaced toward the cover 13 by a distance a above the lower surface of the guide rib 14, a signal representative of the presence of the paper is outputted.

FIG. 30 shows a condition of the actuator 27, where the first angular moment $M_1$ alone works on the actuator 27 to cause the contact portion 27*a* thereof to contact the rear surface of the cover 13. In this condition, the projecting length of the pin plunger 31 is $D_3$, and a signal representative of the exhaustion of the paper (i.e. absence of the paper) is outputted from the microswitch 26. When a paper exhaustion signal is outputted, the rotation of a driving shaft 32 for driving the feed belt 8 is stopped, and the printing operation 19 of the head of the printer is also stopped simultaneously, so that an idle printing operation of the head of the printer is prevented.

The projecting lengths $D_1$, $D_2$, $D_3$ of the pin plunger 31 naturally have the following relation.

$$D_1 < D_2 < D_3$$

The contact portion 27*a* of the actuator 27 contacts the lower surface of the paper 12 passing between the paper receiving plate 24 and cover 13, and the portion of the paper 12 which passes through this narrow clearance presses down the contact portion 27*a* of the actuator 27 to cause the second angular moment $M_2$ to be exerted on the actuator 27.

The level of the pressing force of the paper 12 applied to the contact portion 27*a* of the actuator 27 is determined by the tensile force applied to the paper 12 and the rigidity (hardness or firmness) of the paper 12 itself. The position of the contact portion 27*a* of the actuator 27 is determined when the second angular moment $M_2$ occurring due to the pressing force of the paper 12 applied to the contact portion 27a and the first angular moment $M_1$ occurring due to the projecting force of the pin plunger 31 of the microswitch 26 are balanced. When the distance between the upper surface of the contact portion 27a and that of the paper receiving plate 24 is kept smaller than the level a, a signal representative of the presence of the paper is outputted.

However, when the paper 12 being fed is loosened and has a low tensile strength, or when the paper 12 being fed has a low rigidity due to its small thickness or high flexibility, the level of the pressing force of this paper 12 applied to the contact portion 27a of the actuator 27 is small.

In such cases, the paper 12 is deformed due to the contact pressure of the actuator 27 pressing upwardly as shown in FIGS. 26 and 27, and the first and second angular moments $M_1$, $M_2$ are balanced, with the distance a' between the upper surface of the contact portion 27a of the actuator 27 and the upper surface of the paper receiving plate 24 larger than the distance a referred to above. Consequently, a paper exhaustion signal is outputted in spite of the presence of the paper 12 between the paper receiving plate 24 and cover 13.

In some cases, when the paper being fed is suddenly stopped, the contact portion 27a of the actuator 27 is not positioned properly and a paper exhaustion signal is erroneously generated.

When the detection of exhaustion of paper is thus made erroneously, the printer is stopped erroneously, so that the printing operation is interrupted to cause the paper 12 which had already been printed upon to be rendered unusable, and the user incurs a great loss due to the unnecessary interruption of the printing operation.

SUMMARY OF THE INVENTION

A first embodiment of the invention is directed to a paper exhaustion detector for a paper feeder, having a paper feed belt provided between first and second side frames, a cover adapted to substantially prevent the paper from floating and joined to the first side frame so that the cover can be opened and closed, a paper receiving plate adapted to receive the paper being fed and extending sideways and horizontally from the second side frame, a paper exhaustion detector provided on the second side frame, and an actuator adapted to operate the paper exhaustion detector and provided on the lower side of the paper receiving plate extending from the second side frame. A contact portion of the actuator projects from a position below the paper receiving plate to a position above the upper surface thereof. The paper is fed with the contact portion of the actuator contacting the lower surface thereof, such that exhaustion of the paper is detected when the contact portion of the actuator is displaced to a position higher than a set level. The paper feeder further includes a paper contactor which projects from the portion of the rear surface of the cover which is close, in plan view, to the contact portion of the actuator, and which contacts the upper surface of the portion of the paper which passes over the contact portion of the actuator, so as to prevent this portion of the paper from being significantly deformed by the contacting pressure of the actuator.

Accordingly, the upper surface of the portion of the paper which passes over the contact portion of the actuator contacts the paper contactor projecting from the rear surface of the cover, and is supported by this contactor. As a result, the span between the members supporting the portion of the paper which passes over the contact portion of the actuator can be reduced. Therefore, even when thin paper or highly flexible paper is fed, the paper can be prevented from deforming upwardly in spite of the contacting pressure of the actuator. This enables the presence and exhaustion of the paper to be correctly detected.

A second embodiment of the invention is directed to a paper exhaustion detector for a paper feeder, wherein a paper holding member lightly presses the paper being fed against the upper surface of the paper receiving plate so as to prevent the paper from floating. The paper holding member is attached to the rear surface of the cover and is provided at the portion thereof which is opposed to the contact portion of the actuator with a bore through which this contact portion can extend upwardly.

The paper holding member attached to the rear surface of the cover is provided with a bore which is used to let the contact portion of the actuator extend therethrough in the upward direction. Therefore, the paper passing over the upper surface of the paper receiving plate is prevented from significantly deforming in the upward direction in spite of the contacting pressure of the actuator. When the paper runs out, the contact portion of the actuator extends upwardly through the bore provided in the paper holding member, so that exhaustion of the paper is detected.

Accordingly, even when thin paper or highly flexible paper is fed, upward deformation of the paper can be prevented in spite of the contacting pressure of the actuator, so that the presence and exhaustion of the paper can be correctly detected.

BRIEF DESCRIPTION OF THE DRAWINGS

FIGS. 1–17 illustrate a first embodiment of the present invention, wherein:

FIG. 1 is an exploded view in perspective of a paper feeder of the first embodiment;

FIG. 2 is a plan view of paper having perforations in both edge portions thereof;

FIGS. 3–6 are a plan view, a front elevation, a rear elevation and a side elevation of the paper feeder of the first embodiment;

FIGS. 7 and 8 are sectional views taken along the lines $X_1$–$X_1$ and $X_2$–$X_2$, respectively, in FIG. 6;

FIG. 9 is a side elevation of the paper feeder 1 with the paper loaded therein for feeding;

FIG. 10 is a sectional view taken along the line $X_3$–$X_3$ in FIG. 9;

FIG. 11 is a sectional view of the paper feeder similar to FIG. 10, but with the paper exhausted;

FIGS. 12–17 are enlarged views of modified examples of paper contactors projecting from the rear surface of a cover of the paper feeder;

FIGS. 18–25 illustrate a second embodiment of the present invention, wherein:

FIG. 18 is an exploded view in perspective of a cover and a paper holding member of a paper feeder according to the second embodiment;

FIG. 19 is a perspective view of the cover with the paper holding member attached to the rear surface thereof;

FIG. 20 is a side elevation of the paper feeder of the second embodiment;

FIG. 21 is a sectional view taken along the line $X_4$-$X_4$ in FIG. 20;

FIG. 22 is a sectional view taken along the line $X_5$-$X_5$ in FIG. 20;

FIG. 23 is a side elevation of the paper feeder with the paper loaded therein for feeding;

FIG. 24 is a sectional view taken along the line $X_6$-$X_6$ in FIG. 23;

FIG. 25 is a sectional view of the paper feeder similar to FIG. 24, but with the paper exhausted line;

FIGS. 26-30 illustrate conventional techniques, wherein:

FIG. 26 is a side elevation of a conventional paper exhaustion detector for a paper feeder;

FIG. 27 is a sectional view taken along the line $X_7$-$X_7$ in FIG. 26;

FIG. 28 is a sectional view of an actuator in the conventional paper feeder in a position in which a signal will be outputted to indicate of the presence of paper;

FIG. 29 is a sectional view similar to FIG. 29, but in a most extreme position in which a signal will be outputted to indicate of the presence the paper; and FIG. 30 is a sectional view similar to FIG. 29, but in a condition in which a paper exhaustion signal will be outputted.

DETAILED DESCRIPTION OF THE INVENTION

First, a first embodiment of the invention will be described.

Figure 8:
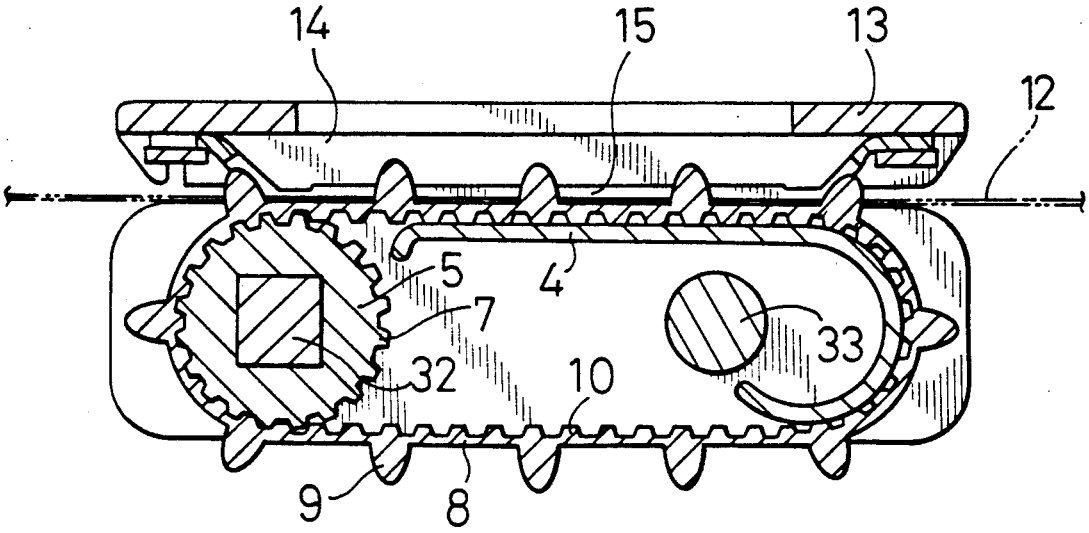

Referring to FIGS. 1-8, a bore 3 is provided in a longitudinal end portion of each of first and second side frames 2*a*, 2*b*, and a belt receiver 4 is formed on the inner side surface of the second side frame 2*b*, one end portion of this belt receiver 4 being formed arcuately (refer to FIG. 8).

A driving sprocket 5 consists of a rotary shaft 6 having a larger-diameter portion at the intermediate part thereof, and external teeth 7 provided on the surface of the larger-diameter portion. The rotary shaft 6 of the driving sprocket 5 is inserted in the bores 3 in the first and second side frames 2*a*, 2*b* and is rotatably supported therein.

An endless feed belt 8 is provided on the outer circumferential surface thereof with a plurality of feed pins 9 projecting therefrom at a predetermined pitch, and on the inner circumferential surface thereof with internal teeth 10. The outer circumferential surface of the feed belt 8 constitutes a paper feed surface 11.

As shown in FIG. 8, the feed belt 8 is wrapped around the driving sprocket 5, which is supported rotatably between the first and second side frames 2*a*, 2*b*, and the belt receiver 4 provided on the inner side surface of the second side frame 2*b*.

As shown in FIG. 8, the internal teeth 10 of the feed belt 8 and the external teeth 7 of the driving sprocket 5 are meshed with each other, and the feed belt 8 is moved cyclically in accordance with the rotation of the driving sprocket 5. A plurality of holes 12*a* (refer to FIG. 2) are provided at a predetermined pitch in both edge portions of the paper 12, and feed pins 9 on this feed belt 8 are inserted in the holes 12*a*, the paper 12 being fed in accordance with the cyclic movement of the feed belt 8.

Figure 1:
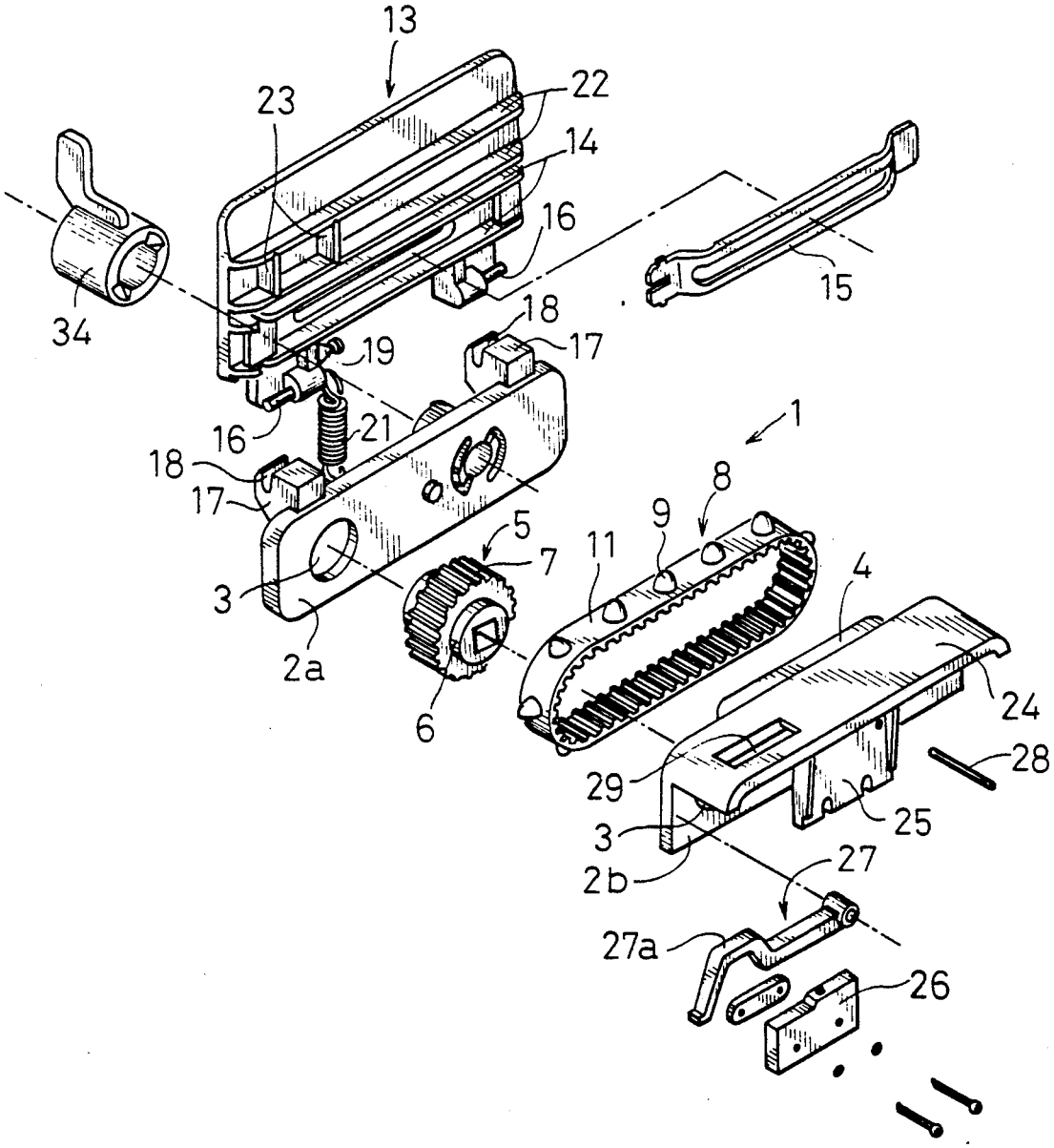
Figure 2:
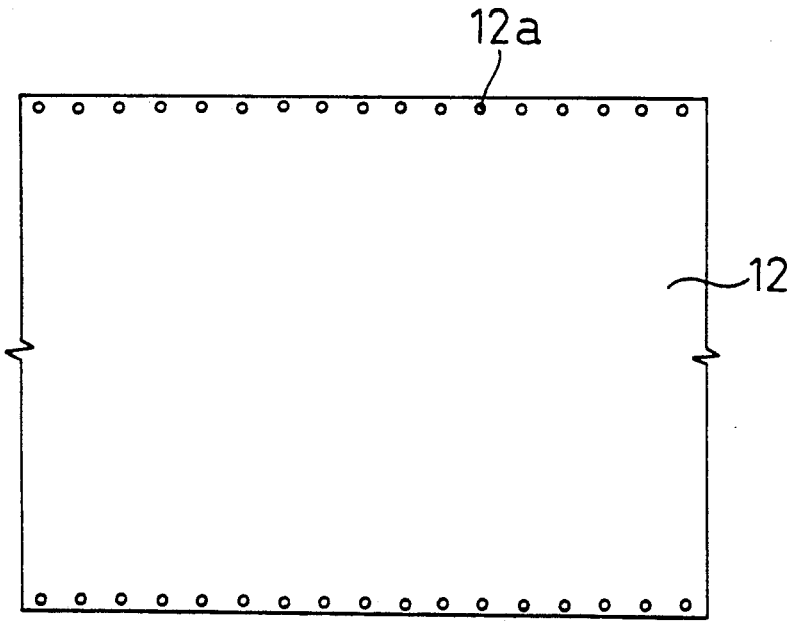
Figure 3:
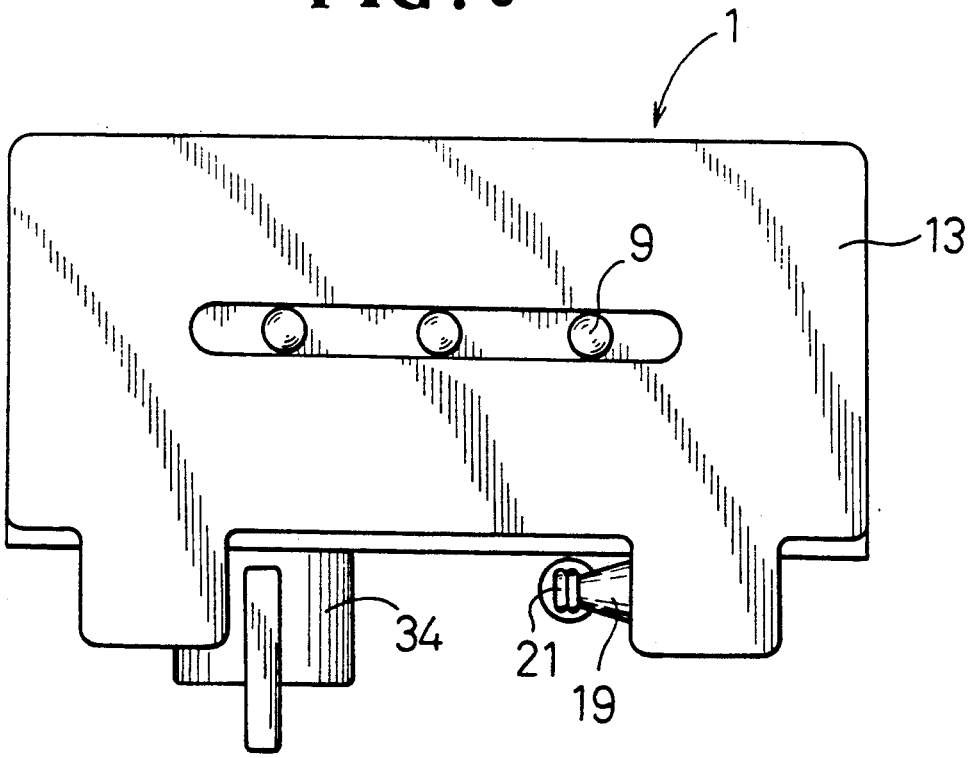
Figure 4:
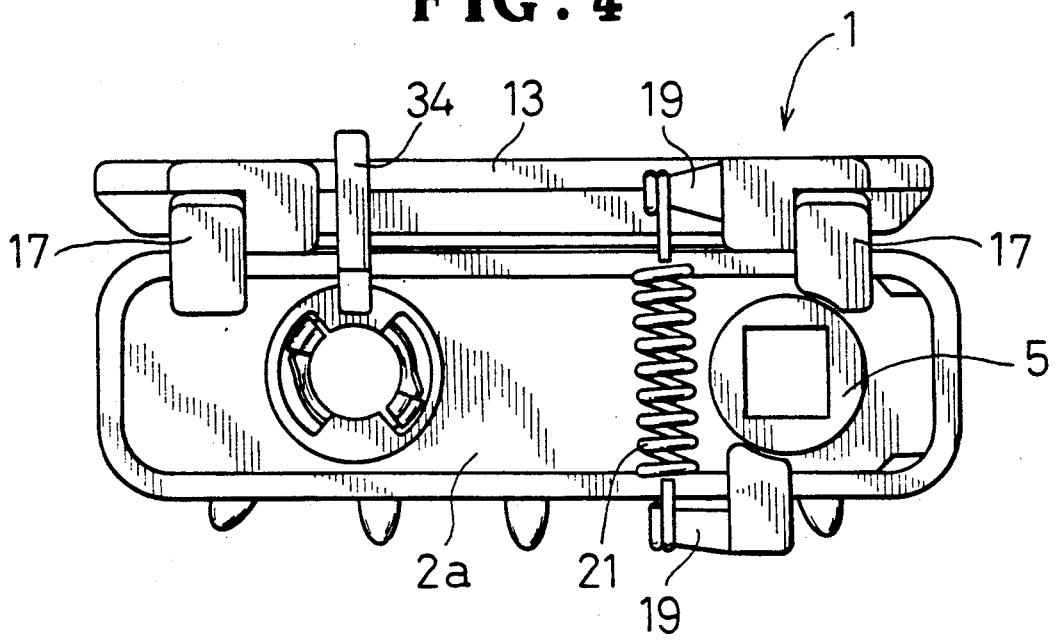
Figure 5:
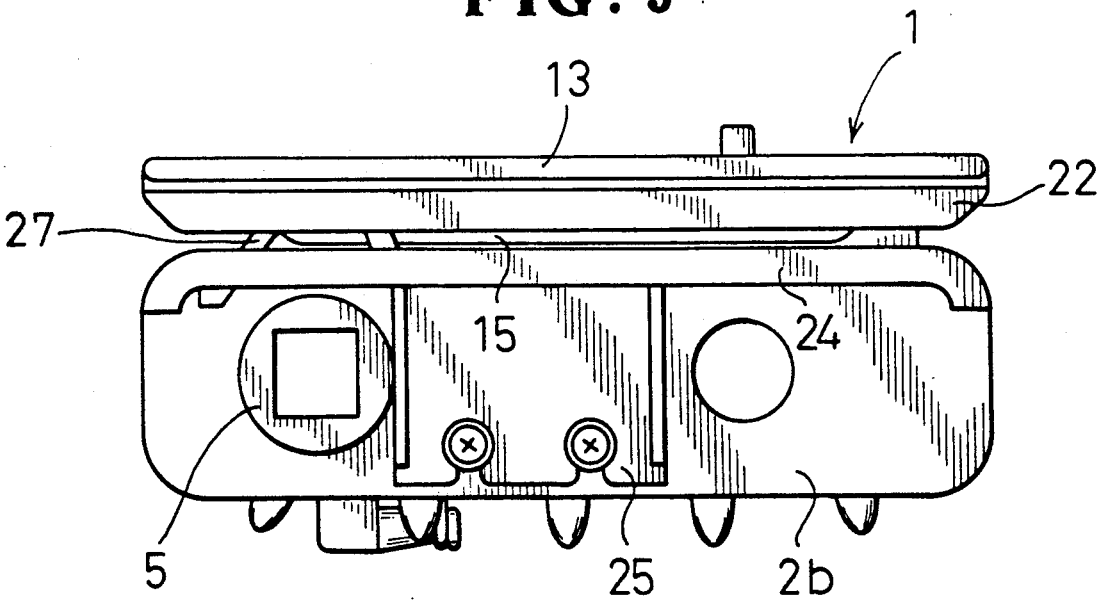
Figure 6:
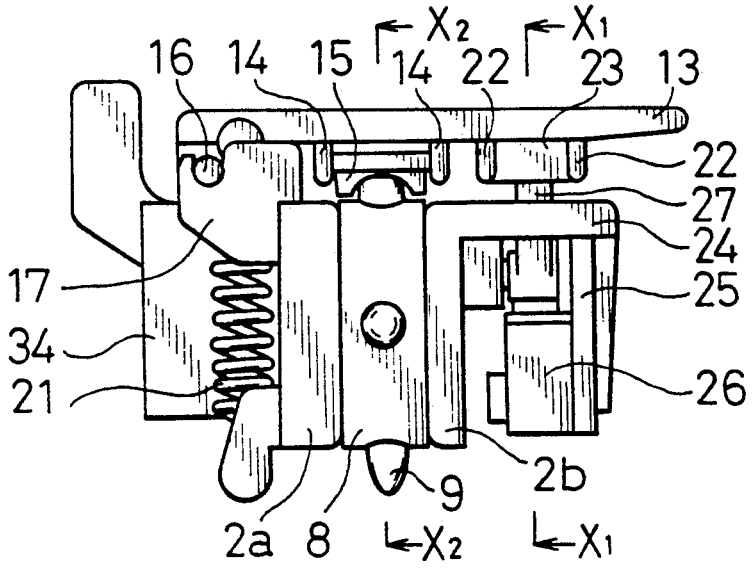
Figure 7:
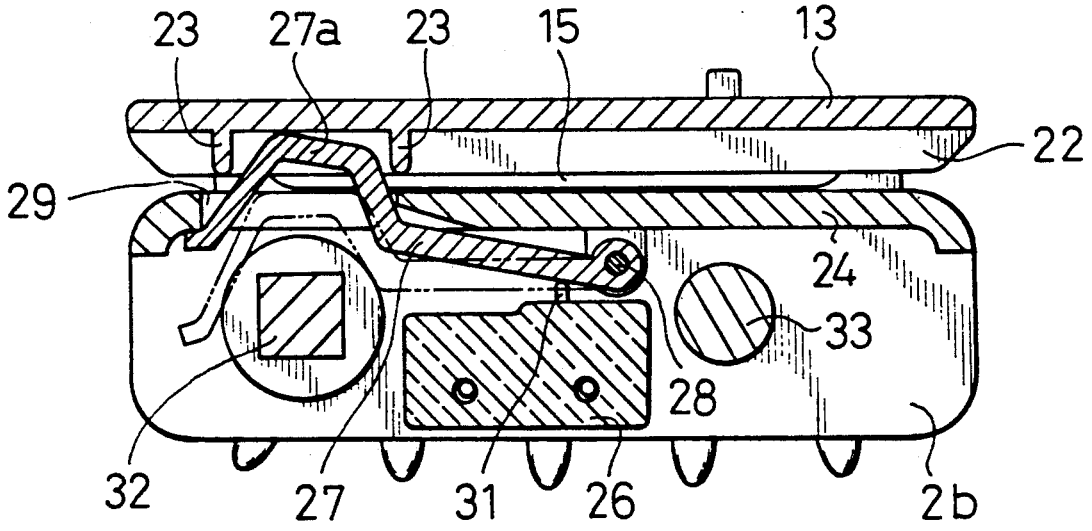

As shown in FIGS. 1 and 6, a pair of guide ribs 14 are projected from the rear surface of a plate of a cover 13 so that the guide ribs 14 are spaced from each other at a predetermined distance and extend in the paper feeding direction, and a paper holding member 15 is fixed between the guide ribs 14.

The cover 13 is provided with a pair of fulcrum shafts 16, and the first side frame 2*a* is provided with a pair of cover receiving portions 17 opposed to these fulcrum shafts 16. The two fulcrum shafts 16 provided on the cover 13 are inserted in grooves 18 provided in the two cover receiving portions 17, and a tension spring 21 is hooked at both of its both of its end portions on spring arms 19 provided on the cover 13 and first side frame 2*a*, respectively. Thus, the cover 13 is attached to the first side frame 2*a* so that the cover 13 can be opened and closed.

When the cover 13 is closed, the paper holding member 15 is positioned just above the feed belt 8 and presses downwardly against the portions of the paper 12 which surrounds the holes 12*a* so as to prevent these portions of the paper 12 from floating and becoming disengaged from the feed pins 9.

The cover 13 is further provided on its rear surface with a pair of first (or longitudinal) rib type paper contactors 22 projecting so as to be spaced from each other at a predetermined distance and extending in the paper feeding direction, and a pair of second (or lateral) rib type paper contactors 23 projecting so as to be spaced from each other at a predetermined distance and extending at right angles to the paper feeding direction.

A contact portion 27*a* of an actuator 27, which will be described later, is adapted to enter a space defined by the first and second paper contactors 22, 23.

The first and second paper contactors 22, 23 are provided on the outer side of the two guide ribs 14, and are adapted to bring the contact portion 27*a* of the actuator 27 into contact with the upper surface of the paper 12 passing thereover, and thus substantially prevent this portion of the paper 12 from being deformed in the upward direction in spite of the contacting pressure of the actuator 27.

The second side frame 2*b* is provided with a paper receiving plate 24 formed integrally therewith so as to extend sideways and horizontally therefrom, and a switch mounting plate 25 is fixed to the lower surface of the paper receiving plate 24 so as to be opposed to the outer surface of the second side frame 2*b*.

A microswitch 26 is attached to the inner side of this mounting plate 25, and the actuator 27 is provided between the microswitch 26 and the paper receiving plate 24. This actuator 27 is attached to the second side frame 2*b* for rotation around a fulcrum pin 28. The contact portion 27*a* provided at the free end part of the actuator 27 is formed so that it can project beyond the upper surface of the paper receiving plate 24 through a bore (or hole) 29 provided in the paper receiving plate 24.

A pin plunger 31 of the microswitch 26 is urged in the projecting direction by a compression spring (not shown) contained in the microswitch 26, and contacts the lower surface of a base end portion of the actuator 27. Accordingly, the actuator 27 receives a first angular moment $M_1$, which causes the contact portion 27*a*to be displaced upward, from the pin plunger 31 (refer to FIG. 10).

When the cover 13 is closed, the space defined by the first and second paper contactors 22, 23 is positioned just above the contact portion 27*a* of the actuator 27.

Even when the contact portion 27*a* of the actuator 27 contacts the rear surface of the cover 13, it does not interfere with the first and second paper contactors 22, 23. The first and second paper contactors 22, 23 are preferably so formed that they project to positions which are within the levels at which the contactors 22, 23 do not interfere with the contact portion 27*a* of the actuator 27, and which are the shortest possible distance away from the same contact portion 27*a*. Referring to the drawings, a reference numeral 32 denotes a driving shaft inserted in a cross-sectionally square bore in the driving sprocket 5, reference numeral 33 denotes a support shaft for firmly mounting the paper feeder 1, and reference numeral 34 denotes a clamp lever for use in clamping the paper feeder 1 on the support shaft 33.

Since the first and second paper contactors 22, 23 thus project from the portions of the rear surface of the cover 13 which are close in plan view to the contact portion 27*a* of the actuator 27, the upper surface of the portion of the paper 12 which passes over the contact portion 27*a* of the actuator 27 is supported in a contacting state by the first and second paper contactors 22, 23.

Figure 9:
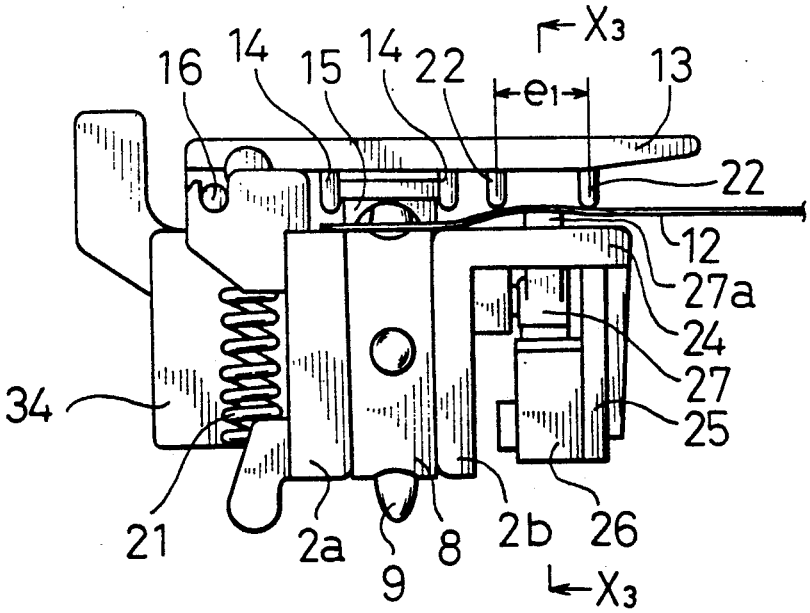
Figure 10:
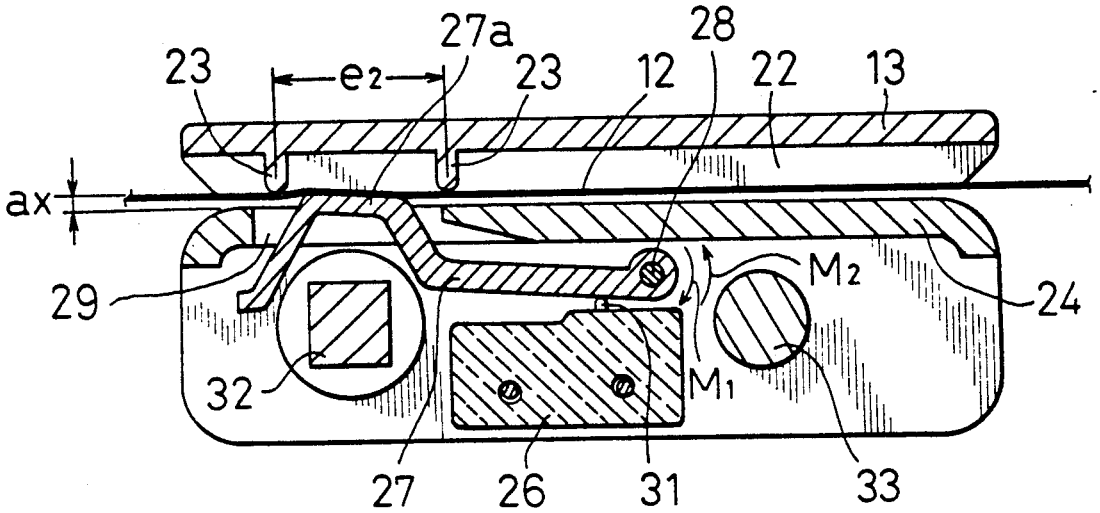

As shown in FIGS. 9 and 10, the first paper contactors 22 extending in the direction perpendicular to the paper feed direction to support the portion of the paper which passes over the contact portion 27*a* of the actuator 27 are spaced apart by a distance $e_1$. The second paper contactors 23 extending in the direction parallel to the paper feed to support direction the same portion of the paper are spaced apart by a distance $e_2$.

Therefore, according to the present invention, the portion of the paper 12 which passes over the contact portion 27*a* of the actuator 27, is supported along directions parallel to and perpendicular to the paper feed direction at points much closer together than paper in a paper feeder not provided with the contactors of the present invention.

Accordingly, even when thin paper 12 highly flexible paper 12 is fed, it can be prevented from deforming upwardly in spite of the contacting pressure of the actuator 27. Consequently, the downward force of the paper 12 against the contact portion 27*a* of the actuator 27 does not decrease significantly during feeding of the paper 12. Thus, the second angular moment $M_2$ consisting of this downward force exerted on the actuator 27 and the first angular moment $M_1$ consisting of the projecting force of the pin plunger 31 of the microswitch 26 are properly balanced (FIGS. 9 and 10) (such that a distance $a_x$ between the upper surface of the contact portion 27*a* of the actuator 27 and that of the paper receiving plate 24 is shorter than the previously-mentioned distance a), so that the exhaustion of the paper is not erroneously detected while the paper is being fed.

Figure 11:
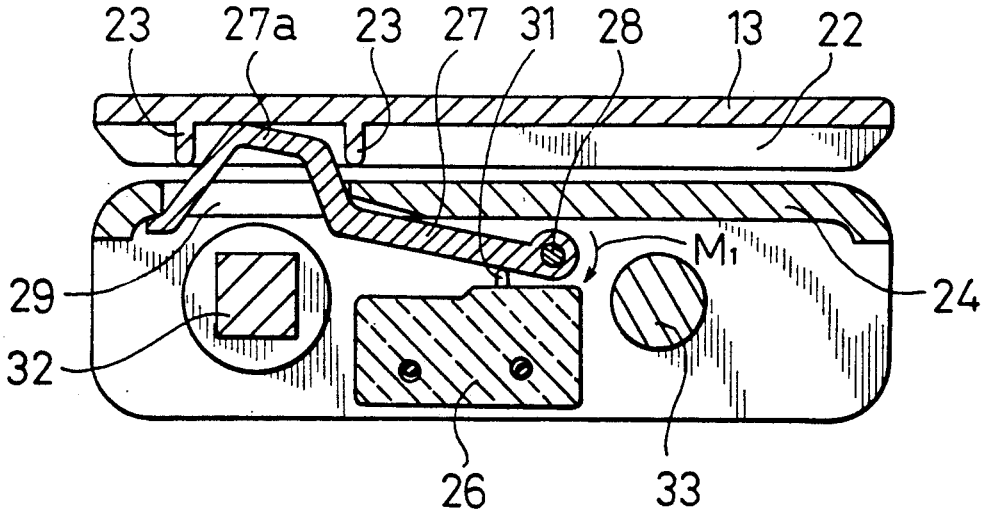

When only the paper runs out, the first angular moment $M_1$ is exerted on the actuator 27, and the contact portion 27*a* of the actuator 27 enters the space surrounded by the first and second paper contactors 22, 23 to contact the rear surface of the cover 13 as shown in FIG. 11, whereby the exhaustion of the paper is detected.

FIGS. 12–17 show various modified examples of the paper contactors provided on the rear surface of the cover 13 so as to project therefrom.

Figure 12:
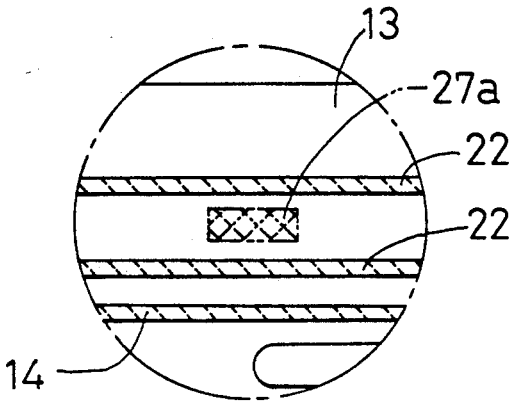
Figure 13:
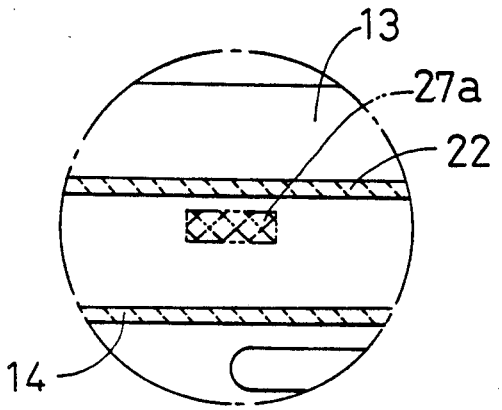
Figure 14:
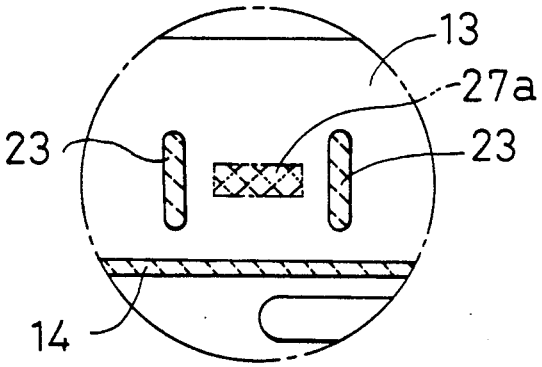
Figure 15:
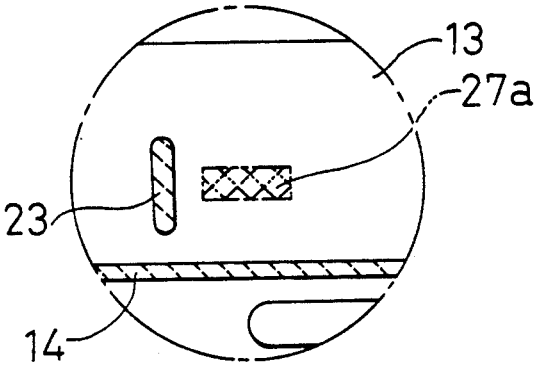

FIG. 12 shows an example in which only a pair of first paper contactors 22 are provided in a projecting state on the rear surface of the cover 13 so as to extend in the direction parallel to the paper feed direction. FIG. 13 shows an example in which only one first paper contactor 22 is provided in a projecting state on the rear surface of the cover 13 so as to extend in the direction parallel to the paper feed direction. FIG. 14 shows an example in which only a pair of second paper contactors 23 are provided in a projecting state on the rear surface of the cover 13 so as to extend at right angles to the paper feed direction and FIG. 15 shows an example in which only one second paper contactor 23 is provided in a projecting state on the rear surface of the cover 13 so as to extend at right angles to the paper feed direction. These paper contactors also enable the span between the members supporting the paper 12 to be reduced.

Figure 16:
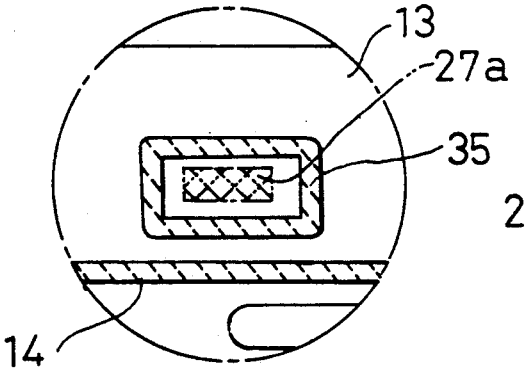
Figure 17:
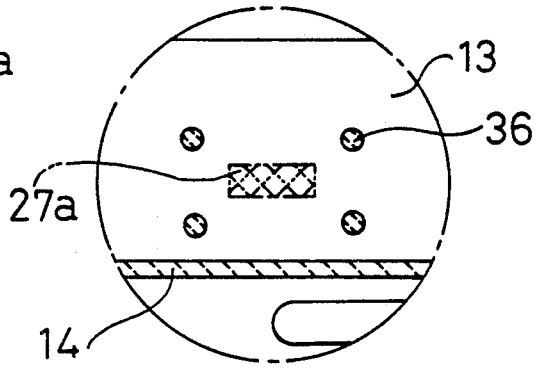

FIG. 16 shows an example in which a rib type paper contactor 35 is provided in a projecting state on the rear surface of the cover 13 so as to surround the whole circumference of the contact portion 27*a* of the actuator 27. FIG. 17 shows an example in which a plurality of pin type paper contactors 36 are provided in a projecting state on the rear surface of the cover 13 so as to be positioned around the contact portion 27*a* of the actuator 27. All of these paper contactors 35, 36 are arranged so as to surround the contact portion 27*a* of the actuator 27. Accordingly, the span in both the paper feed direction and the direction which is at right angles thereto between the members supporting the portion of the paper which passes beneath the same members can be reduced, and a large upward deformation of the paper 12 can be prevented in spite of the contacting pressure of the actuator 27.

A second embodiment of the invention will now be described with reference to FIGS. 18–25. The parts of this embodiment which are identical with those of the embodiment described above of the first invention are designated by the same reference numerals, and only the parts of the second embodiment that are different from those of the first embodiment will be described.

Figure 18:
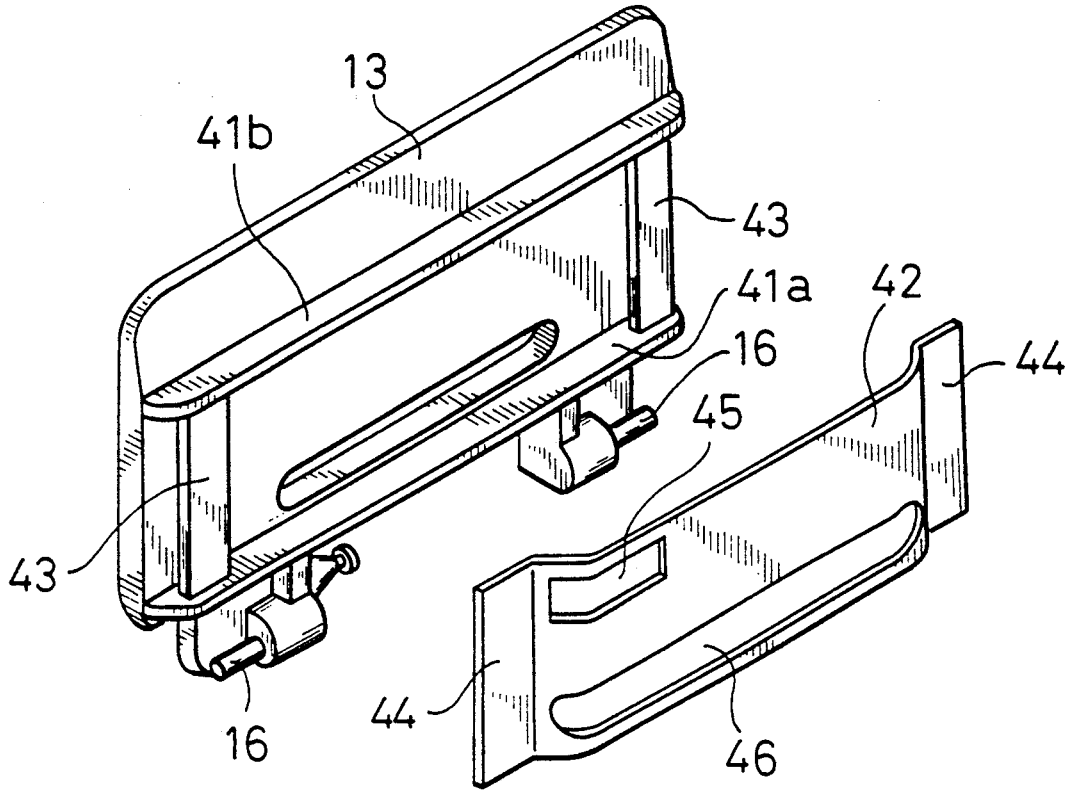
Figure 19:
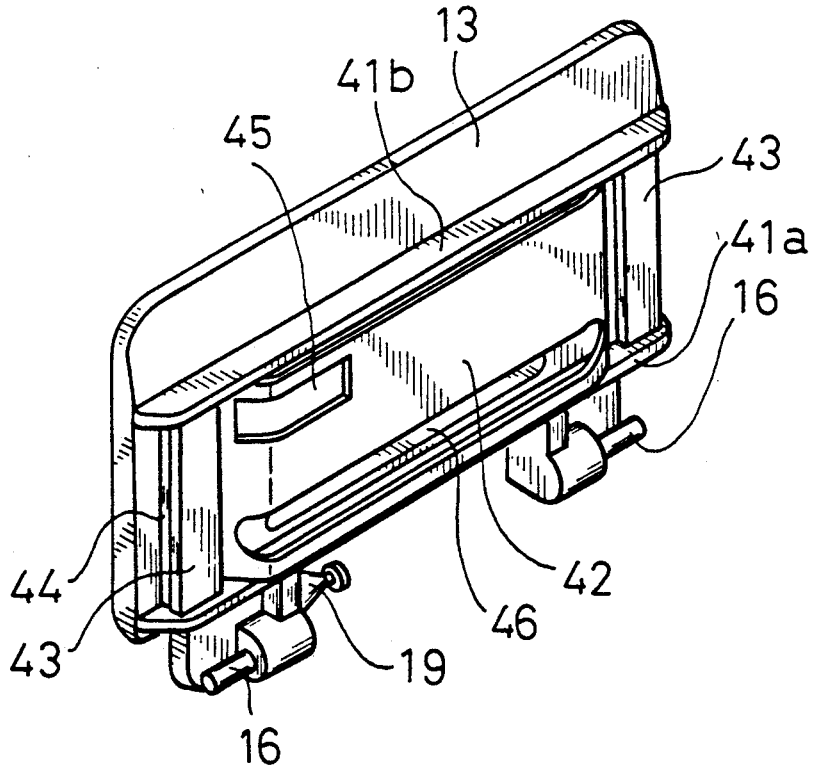

As shown in FIGS. 18 and 19, a pair of guide ribs 41*a*, 41*b* are provided on the rear surface of a cover 13 so as to project therefrom and extend in the direction parallel to the paper feed direction so that these guide ribs 41*a*, 41*b* are spaced from each other by a predetermined distance. When the cover 13 is closed, one guide rib 41*a* is positioned opposite a first side frame 2*a*, while the other guide rib 41*b* is positioned opposite the upper surface of a paper receiving plate 24.

A paper holding member 42 is fitted firmly between these two guide ribs 41*a*, 41*b*. Lip receivers 43 are provided on the portions of the rear surface of the cover 13 which are between both end portions of the two guide ribs 41*a*, 41*b*, and slide lips 44 provided at both end portions of the paper holding member 42 are inserted into the lip receivers 43, whereby the paper holding member 42 is fastened to the rear surface of the cover 13.

Figure 20:
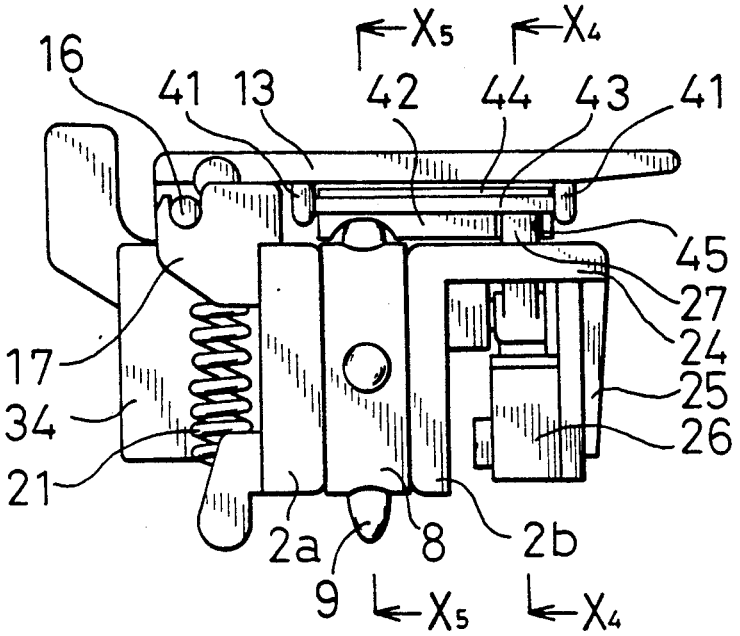
Figure 21:
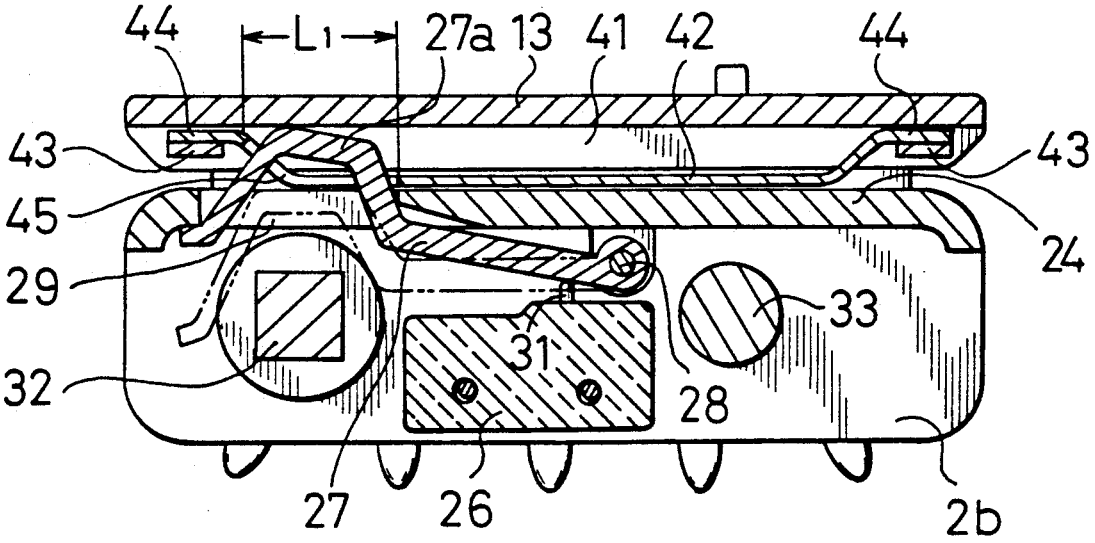
Figure 22:
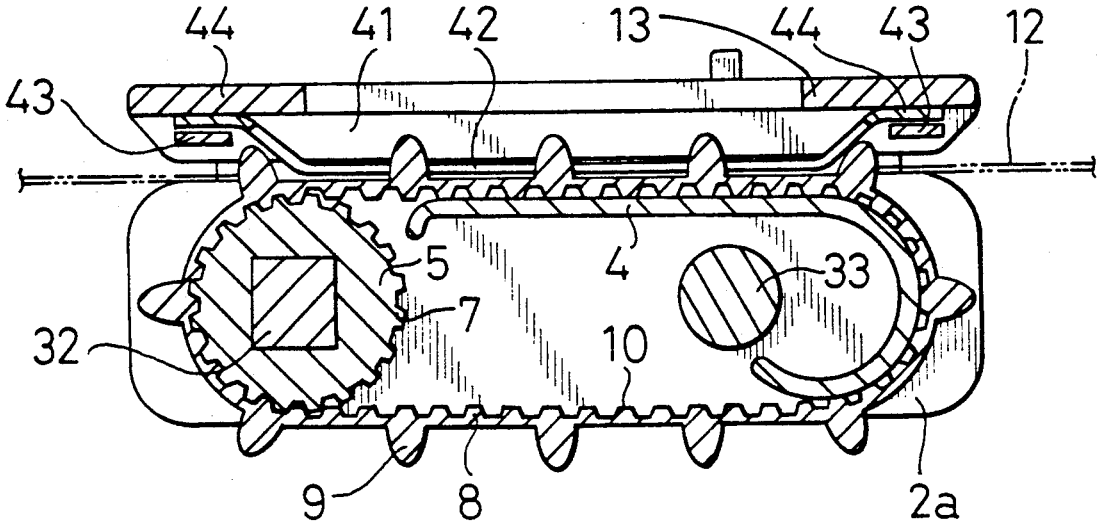

When the cover 13 is closed, the paper holding member 42 attached to the rear surface of the cover 13 extends toward an actuator 27 fixed to a second side frame 2*b*, as shown in FIG. 20. The paper holding member 42 has an elongated slot 46 formed therethrough. The paper holding memberis also provided is provided through a portion thereof which is opposed to a contact portion 27*a* of the actuator 27 with a bore 45, into which the contact portion 27*a* of the actuator 27 is moved when the paper being fed runs out. In order to minimize the quantity of the portion of the paper 12 which passes over the contact portion 27*a* of the actuator 27 and deforms upwardly due to the contacting pressure of the actuator, it is preferable that the length $L_1$, i.e. the size measured in the paper feed direction of the bore 45 for the actuator, and the width $L_2$ of the bore 45 (see FIGS. 21 and 23) be as small as possible, but sufficiently large that the actuator 27 does not interfere with the paper holding member 42. The paper holding member 42 is provided with another bore 46 through which the feed pins 9 provided on a feed belt 8 extend while the belt 8 is rotated.

Figure 23:
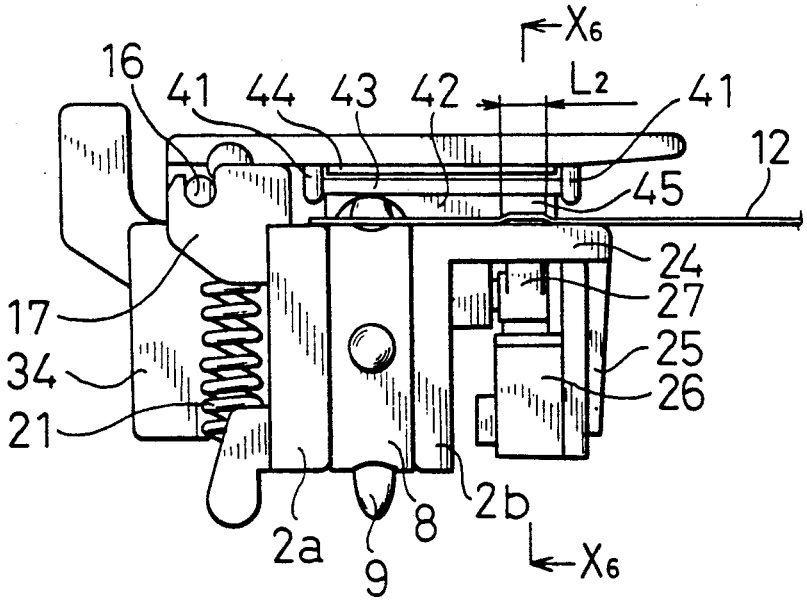
Figure 24:
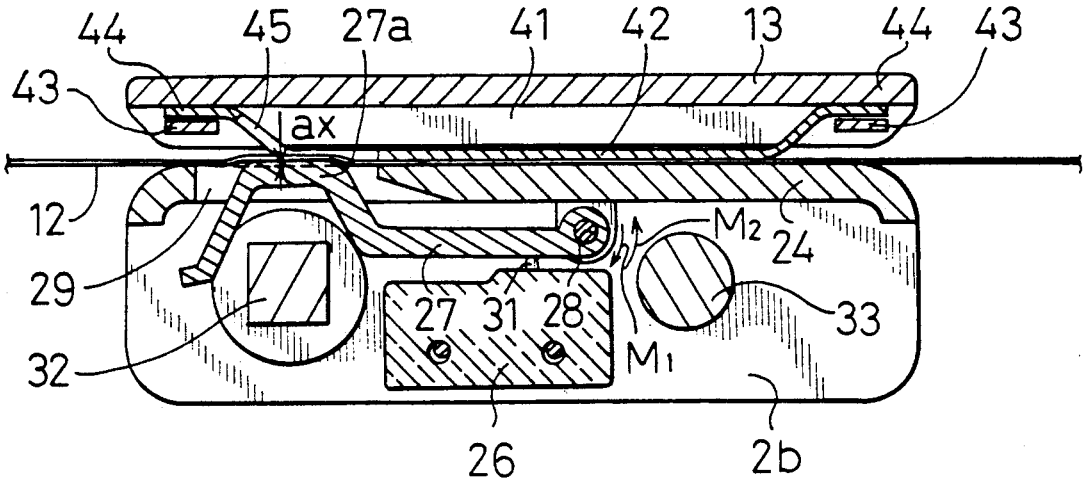

When this feed belt 8 is rotated with the feed pins 9 thereon fitted in the perforations 12*a* in the paper 12 as shown in FIGS. 23 and 24, the paper 12 is fed as it is lightly pressed by the paper holding member 42 attached to the rear surface of the cover 13, against both the paper feed surface 11 of the feed belt 8 and the upper surface of a paper receiving plate 24 provided on a second side frame 2*b*. The contact portion 27*a* of the actuator 27 extends from below the paper receiving plate 24 to above it through a bore 29 to contact with a predetermined pressure the lower surface of the portion of the paper 12 which passes over this contact portion 27*a*.

Since the portion of the paper 12 which passes over the contact portion 27*a* of the actuator 27 is thus lightly pressed against the upper surface of the paper receiving plate 24 by the paper holding member 42, floating of the paper is prevented. Since the length $L_1$ and width $L_2$ of the bore 45 provided in the paper holding member 42 are small as possible without causing the paper holding member 42 to interfere with the contact portion 27*a* of the actuator, the portion of the paper which passes over the contact portion 27*a* is prevented from significantly deforming upwardly in spite of the contacting pressure of the actuator 27.

Accordingly, the first and second angular moments $M_1$, $M_2$ are properly balanced (refer to FIGS. 23 and 24) (such that a distance $a_x$ between the upper surfaces of the contact portion 27*a* of the actuator 27 and paper receiving plate 24 is shorter than the previously-mentioned distance a), and the exhaustion of the paper is not erroneously detected while the paper is being fed.

Figure 25:
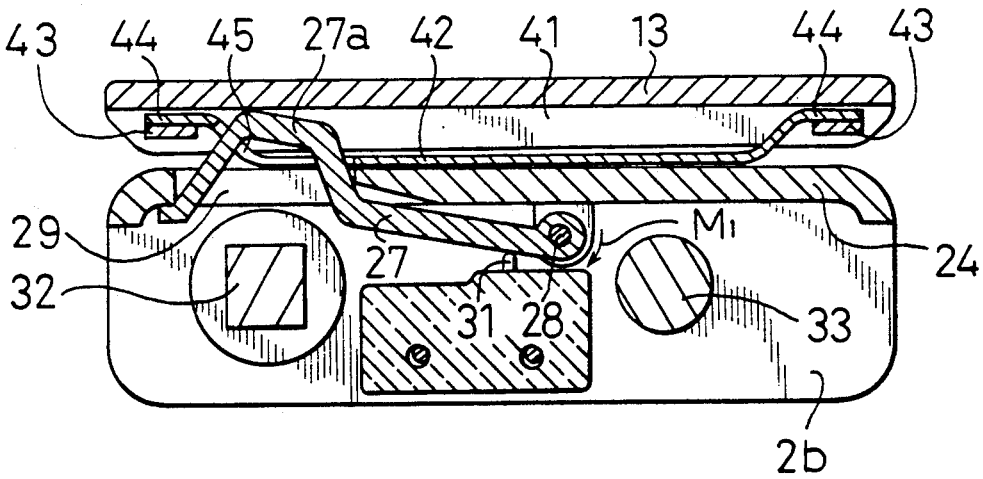

When the paper is exhausted, only the first angular moment $M_1$ is exerted on the actuator 27, and the contact portion 27 thereof enters the bore 45 provided in the paper holding member 42 to contact the rear surface of the cover 13 as shown in FIG. 25, so that the exhaustion of the paper is detected.

What is claimed is:

1. A cover for a paper feed tractor having a first side frame, a second side frame, a paper receiving plate extending substantially perpendicularly from the second side frame and having a hole formed therein, a paper feed belt rotatably mounted between the first and second side frames and having outwardly projecting feed pins for engaging perforated paper, and a paper exhaustion detector mounted to the second side frame and including a microswitch which has an upwardly biased plunger, and an actuator pivotable between a first position in which it is pressed upwardly by the plunger such that a contact portion thereof extends through the hole in the paper receiving plate at least a predetermined distance above the paper receiving plate when no paper is present along an upper surface of the paper receiving plate and a second position in which it is pressed downwardly by paper present along the upper surface of the paper receiving plate against the bias of the plunger such that the contact portion extends through the hole in the paper receiving plate a distance less than the predetermined distance above the paper receiving plate, said cover comprising:

a plate;

means for mounting said plate to the first side frame;

a first elongated rib projecting downwardly from a bottom surface of said plate and extending parallel to a direction in which the paper is adapted to be fed;

an elongated slot formed through said plate and extending along one side of said first rib in parallel with said first rib;

a second elongated rib projecting downwardly from said bottom surface of said plate and extending parallel to said first rib on a side of said slot opposite said first rib;

an elongated holding member having an elongated slot formed therethrough along a substantial portion of the length of said paper holding member, and a hole formed therethrough on one side of and spaced apart from said slot of said paper holding member; and means for mounting said paper holding member to said bottom surface of said plate between said first and second ribs such that said slot in said paper holding member is parallel to and located directly below said slot in said plate, said hole formed through said paper holding member being positioned such that when said paper holding member is mounted to said bottom surface of said plate by said mounting means, said hole formed through said paper holding member is adapted to be located directly above the hole in the paper receiving plate.

2. A cover as recited in claim 1, wherein said mounting means comprises a pair of lips attached respectively to each end of said paper holding member, and means mounted on said bottom surface of said plate for engaging said lips.

3. A cover for a paper feed tractor having a first side frame, a second side frame, a paper receiving plate extending substantially perpendicularly from the second side frame and having a hole formed therein, a paper feed belt rotatably mounted between the first and second side frames and having outwardly projecting feed pins for engaging perforated paper, and a paper exhaustion detector mounted to the second side frame and including a microswitch which has an upwardly biased plunger, and an actuator pivotable between a first position in which is it pressed upwardly by the plunger such that a contact portion thereof extends through the hole in the paper receiving plate at least a predetermined distance above the paper receiving plate when no paper is present along an upper surface of the paper receiving plate and a second position in which it is pressed downwardly by paper present along the upper surface of the paper receiving plate against the bias of the plunger such that the contact portion extends through the hole in the paper receiving plate a distance less than the predetermined distance above the paper receiving plate, said cover comprising:

a plate;

means for mounting said plate to the first side frame;

a first elongated rib projecting downwardly from a bottom surface of said plate and extending parallel to a direction in which the paper is adapted to be fed;

an elongated slot formed through said plate and extending along one side of said first rib in parallel with said first rib;

a second elongated rib projecting downwardly from said bottom surface of said plate and extending parallel to said first rib on a side of said slot opposite said first rib; and a plurality of paper contactors having circular cross sections and projecting downwardly from said bottom surface of said plate on a side of said second rib opposite said slot;

wherein said contactors are in surrounding relation to a portion of said bottom surface of said plate which is adapted to be positioned directly above the hole in the paper receiving plate.

4. A cover as recited in claim 3, wherein said plurality of paper contactors comprises four paper contactors.

5. A cover as recited in claim 3, wherein said plurality of paper contactors are spaced from said second rib.

* * * * *